US006659736B2

(12) United States Patent
Maganhoto et al.

(10) Patent No.: US 6,659,736 B2
(45) Date of Patent: Dec. 9, 2003

(54) MOUNTING ARRANGEMENT FOR A HERMETIC COMPRESSOR

(75) Inventors: Sérgio Luiz Maganhoto, Joinville (BR); João Manoel Mendes, Joinville (BR)

(73) Assignee: Empresa Brasileira de Compressores S.A. -Embraco, Joinville (BR)

( * ) Notice: Subject to any disclaimer, the term of this patent is extended or adjusted under 35 U.S.C. 154(b) by 0 days.

(21) Appl. No.: 09/921,985

(22) Filed: Aug. 2, 2001

(65) Prior Publication Data

US 2002/0114712 A1 Aug. 22, 2002

Related U.S. Application Data

(63) Continuation of application No. PCT/BR00/00011, filed on Feb. 3, 2000.

(30) Foreign Application Priority Data

Feb. 4, 1999 (BR) ..... 9900482

(51) Int. Cl.[7] ..... F04B 17/00
(52) U.S. Cl. ..... 417/360
(58) Field of Search ..... 417/360, 363, 417/350; 248/615, 140.11; 62/262

(56) References Cited

U.S. PATENT DOCUMENTS

| | | | | |
|---|---|---|---|---|
| 3,579,809 A | | 5/1971 | Wolf et al. | |
| 4,396,360 A | * | 8/1983 | Elson | 417/363 |
| 5,155,897 A | | 10/1992 | Schleicher | |
| 5,385,453 A | * | 1/1995 | Fogt et al. | 417/410.5 |
| 5,432,989 A | | 7/1995 | Turek | |
| 5,487,648 A | | 1/1996 | Alfano et al. | |
| 5,554,015 A | * | 9/1996 | Dreiman et al. | 384/368 |
| 5,701,668 A | * | 12/1997 | Dreiman et al. | 29/428 |
| 5,711,162 A | * | 1/1998 | Wolanin et al. | 29/513 |
| 6,276,906 B1 | * | 8/2001 | Noguchi | 417/363 |

FOREIGN PATENT DOCUMENTS

WO 98 53205 11/1998

* cited by examiner

*Primary Examiner*—Sang Y. Paik
*Assistant Examiner*—Vinod D Patel
(74) *Attorney, Agent, or Firm*—Darby & Darby

(57) ABSTRACT

A mounting arrangement for a hermetic compressor, comprising a shell (10) formed of a metallic plate and incorporating tubular projections (12) with the upper end **(12*a*) opened to the inside of the shell (10) and with the lower end (12*b*) closed, fitted and tightly retained, by mechanical deformation of the parts, inside a drawn recess (22) of a respective basic plate (20) to be affixed under the shell (10)**.

4 Claims, 4 Drawing Sheets

MOUNTING ARRANGEMENT FOR A HERMETIC COMPRESSOR

This is a continuation of Application No. PCT/BR00/00011, filed Feb. 3, 2000.

FIELD OF THE INVENTION

The present invention refers to a mounting arrangement for the fixation and lower suspension of a hermetic compressor, usually employed in small refrigerating appliances, such as those existing in refrigerators, freezers, etc.

BACKGROUND OF THE INVENTION

There are well known in the prior art the hermetic compressors comprising a shell, which is formed of a steel plate at least in its lower half portion and in whose bottom are affixed external basic plates, for seating and affixing the shell onto a supporting structure. Also in the bottom of the shell are internally attached metallic pins for mounting the lower suspension of a motor-cylinder block assembly provided inside the shell.

In these known compressors, the mounting arrangement of the basic plates and metallic pins to the shell involves the use of welding (of the projection type) as a fixation means between said parts. In this constructive solution, the basic plates are externally welded to the bottom of the shell and then the shell receives internally, also by welding, the metallic pins into which will be posteriorly inserted the suspension means, such as the known suspension pins.

While this mounting arrangement of the prior art leads to a safe mutual fixation of the different parts, it has the inconveniences of a higher cost in the process of joining the component parts, the adjustment of a higher number of parameters of the involved machines in the welding process, less guarantee for maintaining the dimensional standards between the welded parts, a higher number of components to be aggregated to the compressor and a higher number of steps in the manufacturing process.

DISCLOSURE OF THE INVENTION

It is a general objective of the present invention to provide a mounting arrangement for the components considered herein in a hermetic compressor, allowing to simplify the productive process, reducing the number of components and the cost, and offering more guarantee for maintaining the dimensional standards of the product to be obtained.

The objective above is attained by providing a mounting arrangement for a hermetic compressor of the type comprising a shell formed of a metallic plate at least in its lower portion and affixing, externally, basic plates for seating and affixing the hermetic compressor on a supporting structure and, internally, pins for mounting the suspension.

According to the invention, the shell incorporates, inferiorly and in a single piece, for each basic plate, at least one tubular projection with the upper end opened to the inside of the shell and with the lower end closed, fitted and tightly retained inside a drawn recess of a respective basic plate, each tubular projection and each respective drawn recess being mechanically and jointly deformed, so that the lower end of the tubular projection presents an external contour substantially larger than the external contour of the remaining of the axial extension of said tubular projection, the internal contour of the drawn recess being defined by the external contour of the respective tubular projection along the extension thereof.

The mounting arrangement defined above allows to achieve, by means of a single fitting and mechanical shaping operation, the fixation of each basic plate to the shell, with the simultaneous formation of a usually cylindrical housing internally to each tubular projection and which is opened to the inside of the shell, and in whose inside may be fitted a respective pin of the lower suspension system of the motor-cylinder block assembly of the compressor.

BRIEF DESCRIPTION OF THE DRAWINGS

The invention will be described below, with reference to the attached drawings, in which.

BEST MODE OF CARRYING OUT THE INVENTION

As illustrated in the figures, the present mounting arrangement is used to affix, under a shell 10 of a hermetic compressor, a number of basic plates 20, through which the compressor is seated and affixed to a fixation structure.

Figure 1:
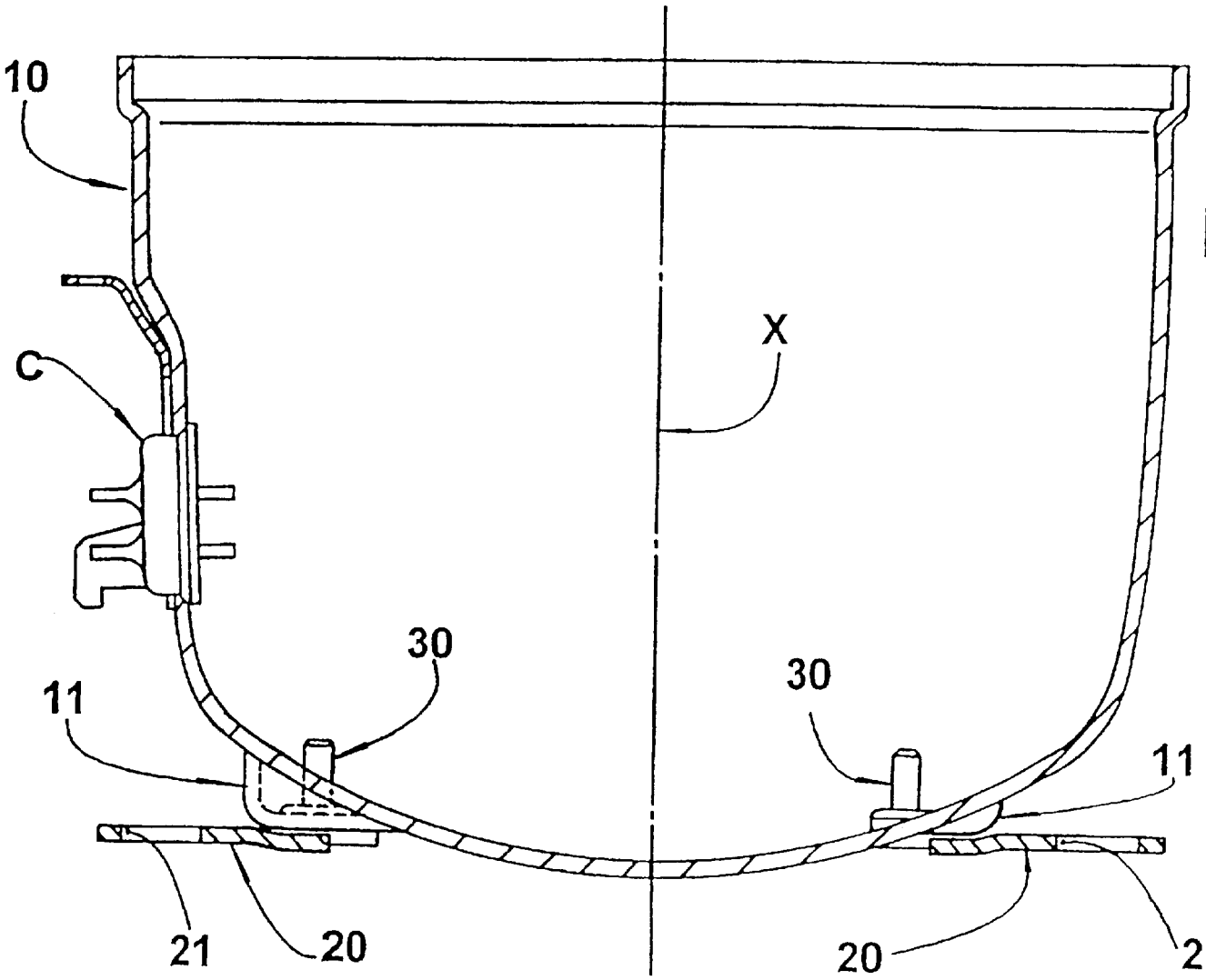
FIG. 1 PRIOR ART
FIG. 1 is a vertical sectional view of the lower portion, or half-lower portion of a shell having a mounting arrangement of basic plates and internal metallic pins according to the prior art.
Figure 2:
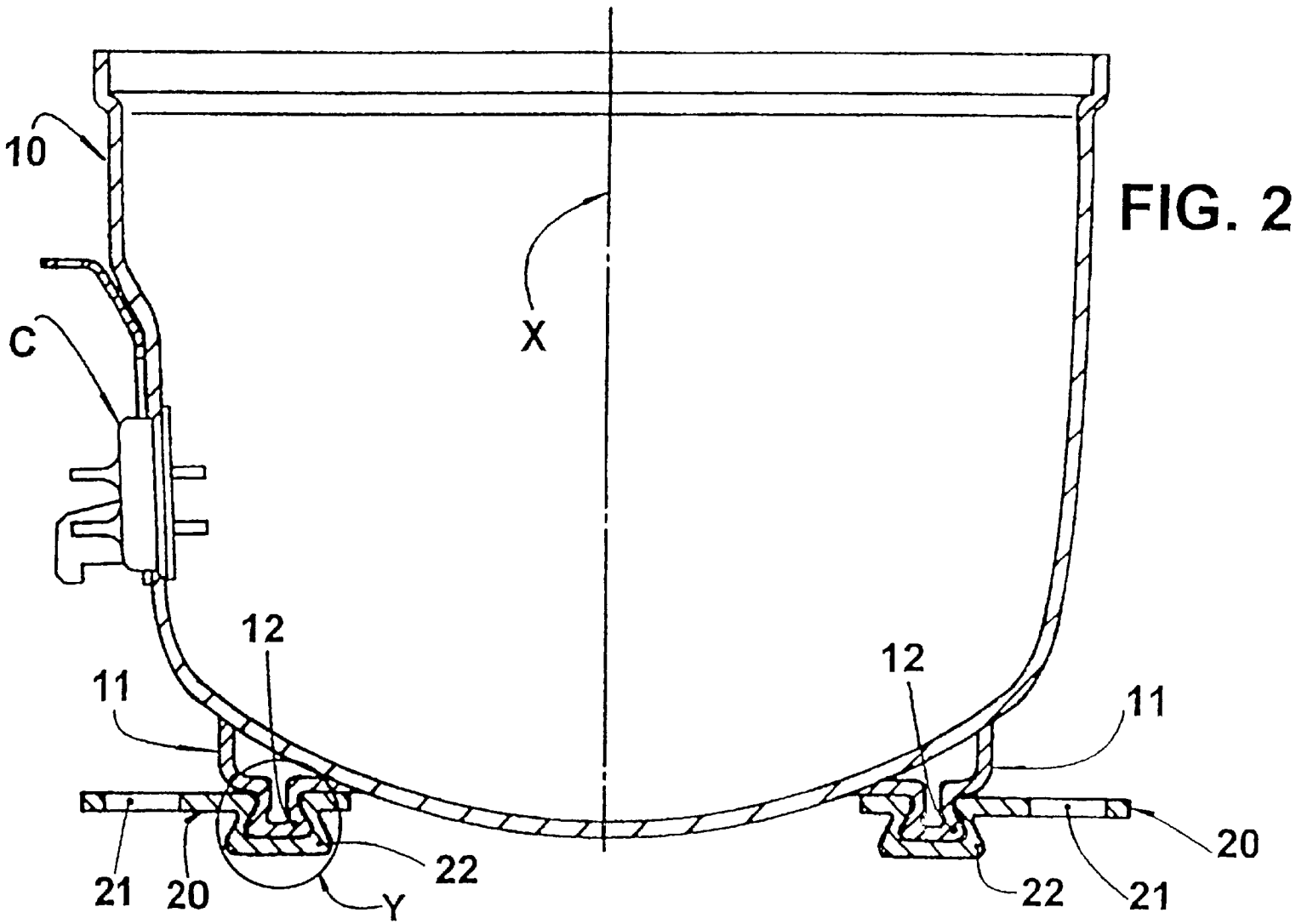
FIG. 2 is a similar view to that of the previous figure, but illustrating the mounting arrangement according to the invention.

Shell 10 is only illustrated from its lower portion, which is formed of a steel plate adequately dimensioned and shaped so as to lodge therewithin, through non-illustrated suspension means, a motor-cylinder block assembly, which is not illustrated either. In FIGS. 1 and 2 is illustrated a lower portion of the shell 10 carrying, in a lateral window, a connector C provided with terminals internally and externally provided in relation to the shell and affixed to a body made of an electrically non-conductive material.

According to the prior art mounting arrangement, as illustrated in FIG. 1, the shell 10 incorporates lower drawn portions 11, whose end wall defines, externally, a surface portion, which is usually orthogonal to the axis X of the shell 10 and against which is welded a respective basic plate 20 provided with at least one throughbore 21 for inserting fastening pins (not illustrated).

Also according to the prior art as illustrated in FIG. 1, the end wall of each lower drawn portion 11 defines, internally, a surface portion, which is usually parallel to the external surface portion and against which is welded the base of a respective metallic pin 30, which is upwardly projected, in order to receive the suspension means of the motor-cylinder block assembly to be mounted inside the shell 10. These suspension means usually comprise helical springs, which are inferiorly fitted into the metallic pins 30 and superiorly coupled to the cylinder block of the compressor.

Figure 3:
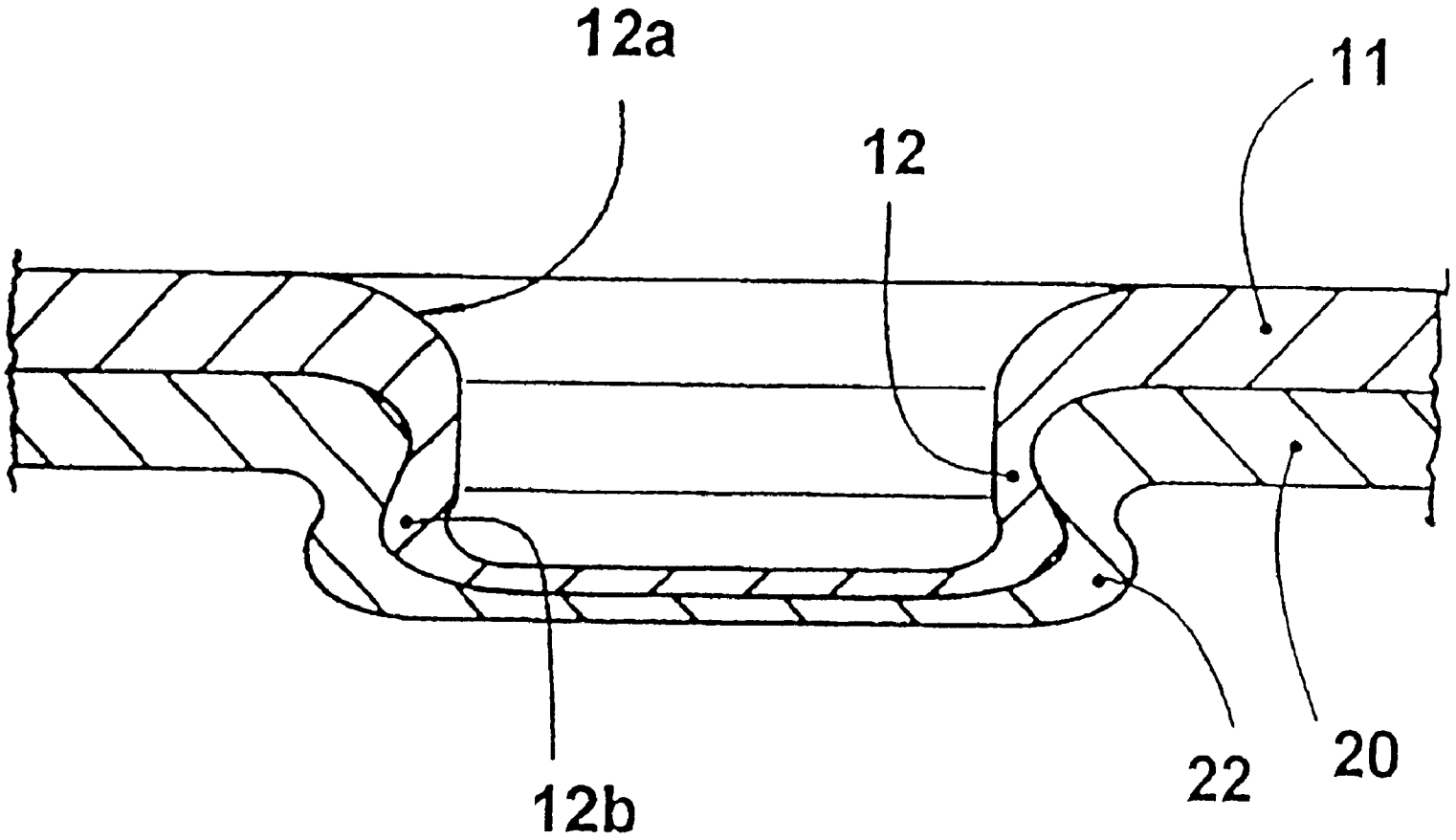
FIG. 3 shows the detail Y enlarged from FIG. 2, illustrating the fixation arrangement between a basic plate and the shell.
Figure 4:
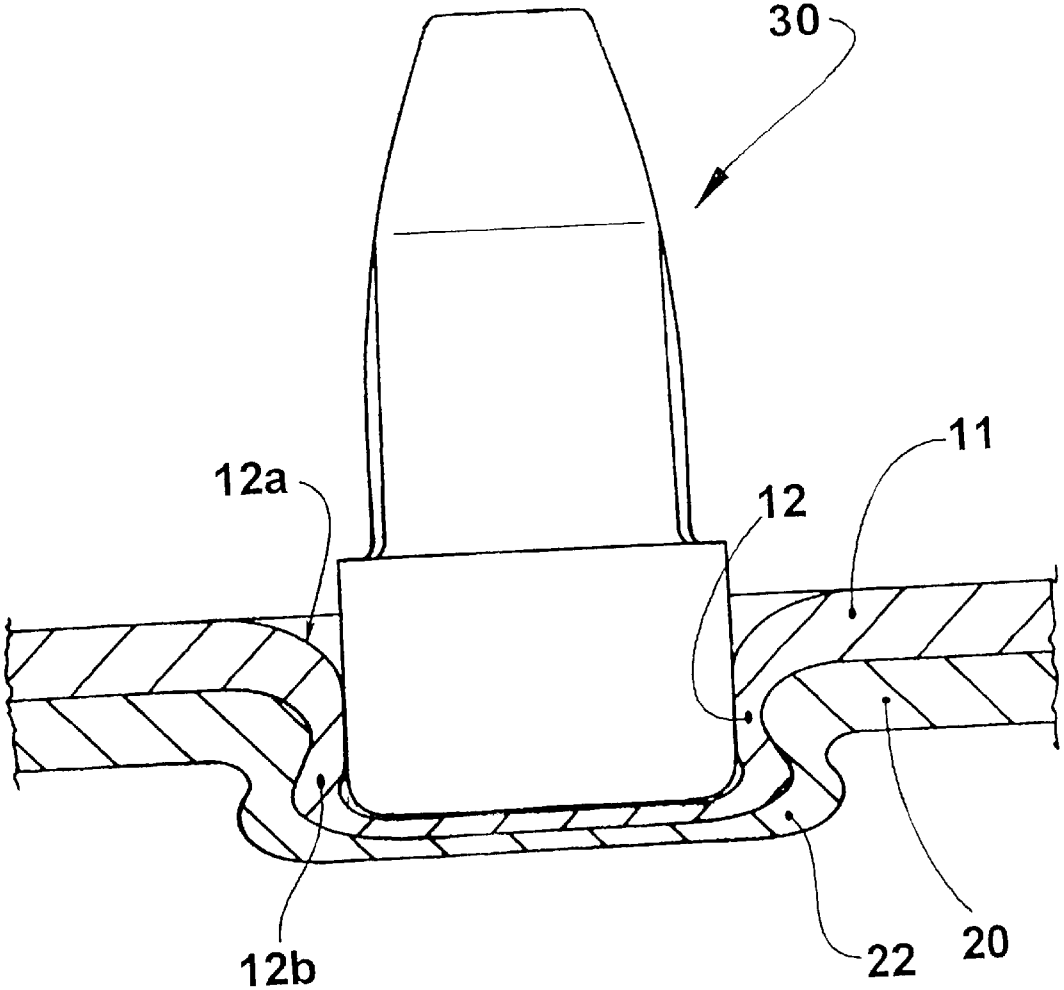
FIG. 4 is a similar view to that of the previous figure, but illustrating a suspension means construction.

The mounting arrangement of the present invention is illustrated in FIGS. 2, 3 and 4. According to the invention, the shell 10 incorporates, inferiorly and in a single piece, more specifically from the end wall of its lower drawn portions 11, according to the illustrated embodiment, a tubular projection 12 with the upper end 12*a* opened to the inside of the shell 10 and with the lower end 12*b* closed.

As illustrated, the tubular projections 12 are usually obtained by drawing and have their lower end 12*b* fitted and tightly retained inside a drawn recess 22 of a respective basic plate 20, it being understood, however, that each basic plate may be coupled to one or more tubular projections.

Each pair of tubular projections 12 and respective drawn recess 22 are mechanically deformed, so that the lower end 12*b* of the tubular projection 12 presents an external contour substantially larger than the external contour of the remaining of the axial extension of said tubular projection 12, whereby said lower end 12*b* takes the form of an enlarged head of usually circular contour.

The drawn recess 22 of the basic plate 20 is deformed together with the respective tubular projection 12 fitted therein, so that its internal contour be defined by the external contour of the respective tubular projection 12 along the extension of the latter. Thus, the drawn recess 22 of the basic plate 20 tightly embraces the lower end 12*b* of the respective tubular projection 12, providing a solid and safe fixation of the basic plate 20 to the shell 10, with no need of welding.

Considering that the basic plates 20 and the shell 10 may be led to a mutual initial fitting of the drawn recesses 22 in the tubular projection 12, which are previously produced at the time in which the basic plates 20 and the shell 10 are stamped, the final fixation operation is achieved by the simple joint mechanical deformation of the fitted parts.

As illustrated in FIGS. 2 and 3, the mechanical deformation of the mutually fitted parts is made in order to maintain the internal transversal section of the tubular projections 12 with a circular or preferably constant polygonal form along the axial extension of said tubular projections 12, allowing that inside the latter be directly fitted the suspension means of the motor-cylinder block assembly (FIG. 4) to be mounted inside the shell 10.

As it may be observed, besides minimizing the welding operations and the previous relative positioning of the parts before the welding, the present arrangement allows to eliminate the usual metallic pins 30 of the prior art.

What is claimed is:

1. A mounting arrangement for a hermetic compressor, comprising a shell (10) formed of a metallic plate at least in its lower portion and affixing, externally, basic plates (20) for seating and affixing the compressor shell (10) on a supporting structure, characterized in that the shell (10) incorporates, inferiorly and in a single piece, for each basic plate (20), at least one tubular projection (12) with an upper end (12*a*) opened to the inside of the shell (10) and with a lower end (12*b*) closed, fitted and tightly retained inside a drawn recess (22) of a respective basic plate (20), each tubular projection (12) and each respective drawn recess (22) being mechanically and jointly deformed, so that the lower end (12*b*) of the tubular projection (12) presents an external contour substantially larger than the external contour of the remaining of the axial extension of said tubular projection (12), the internal contour of the drawn recess (22) being defined by the external contour of the respective tubular projection (12) along the extension thereof.

2. A mounting arrangement, as in claim 1, wherein the tubular projections (12) present, along the axial extension thereof, a substantially constant internal transversal section.

3. A mounting arrangement, as in claim 1, wherein the tubular projection (12) is superiorly incorporated to the end wall of respective lower drawn portions (11) of the shell (10).

4. A mounting arrangement, as in claim 1, wherein said tubular projection (12) and each respective drawn recess (22) are mechanically and jointly deformed in order to inferiorly fit a mechanical pin of a compressor suspension means therein.

* * * * *